US005465906A

United States Patent [19]

Hans

[11] Patent Number: 5,465,906

[45] Date of Patent: Nov. 14, 1995

[54] ELECTROMAGNETICALLY ACTUATABLE INJECTION VALVE HAVING SWIRL CONDUITS

[75] Inventor: Waldemar Hans, Bamberg, Germany

[73] Assignee: Robert Bosch GmbH, Stuttgart, Germany

[21] Appl. No.: 391,304

[22] Filed: Feb. 21, 1995

Related U.S. Application Data

[63] Continuation of Ser. No. 947,599, Sep. 21, 1992, abandoned.

[30] Foreign Application Priority Data

Sep. 21, 1991 [DE] Germany ..... 41 31 499.9

[51] Int. Cl.[6] ..... F02M 51/06; F02M 61/18

[52] U.S. Cl. ..... 239/489; 239/585.5

[58] Field of Search ..... 239/489, 487, 239/533.12, 585.1–585.5

[56] References Cited

U.S. PATENT DOCUMENTS

| | | | |
|---|---|---|---|
| 4,060,199 | 11/1977 | Brüne et al. | 239/488 |
| 4,230,273 | 10/1980 | Claxton et al. | 239/489 |
| 4,732,327 | 3/1988 | Aichele et al. | 239/463 |
| 4,890,794 | 1/1990 | Imafuku et al. | 239/533.12 |
| 4,907,746 | 3/1990 | Aichel et al. | 239/472 |
| 4,981,266 | 1/1991 | Aichele et al. | 239/463 |
| 5,012,981 | 5/1991 | Holzgrefe et al. | 239/533.12 |
| 5,018,501 | 5/1991 | Watanabe et al. | 239/463 |
| 5,058,810 | 10/1991 | Bonfiglioli et al. | 239/489 |

FOREIGN PATENT DOCUMENTS

| | | | |
|---|---|---|---|
| 1573230 | 6/1990 | U.S.S.R. | 239/489 |
| 2232203 | 12/1990 | United Kingdom | 239/533.12 |

*Primary Examiner*—Karen B. Merritt

*Attorney, Agent, or Firm*—Edwin E. Greigg; Ronald E. Greigg

[57] ABSTRACT

An electromagnetically actuatable injection valves which tear away the fuel stream emerging from at least one injection port and atomize it as finely as possible. One possibility is to force a high velocity component in the radial direction upon the fuel prior to its leaving the injection valve; this is achieved with swirl generators. The novel injection valve has a valve seat face, which in a swirl segment outside a sealing face, is provided with four swirl conduits, which discharge into an injection conduit and terminal port with a lateral offset relative to a longitudinal valve axis. The novel injection valve is especially suitable as an injection valve for fuel injection systems of mixture-compressing internal combustion engines with externally supplied ignition.

6 Claims, 2 Drawing Sheets

ELECTROMAGNETICALLY ACTUATABLE INJECTION VALVE HAVING SWIRL CONDUITS

This is a continuation of application Ser. No. 07/947,599 filed on Sep. 21, 1992, now abandoned.

BACKGROUND OF THE INVENTION

The invention is based on an electromagnetically actuatable injection valve as set forth hereinafter. Injection valves are already known German Patent 25 43 805, U.S. Pat. No. 4,060,199; DE-OS 39 43 005, U.S. Pat. No. 5,018,501, which for better preparation of an injected fuel stream include swirl-producing devices either upstream or downstream of a fixed valve seat face.

In U.S. Pat. No. 4,060,199, an injection valve has already been described in which for improved preparation of the injected fuel stream, swirl conduits are located upstream of the valve seat face on a valve needle and serve to swirl the fuel stream. These swirl conduits impose a radial velocity component upon the fuel emerging from an injection port, and as a result the fuel stream is torn away and made turbulent. A disadvantage in this version is that because of an undercut necessary for production reasons upstream of the valve seat face, against which the fuel strikes downstream of the swirl conduits, a majority of the spin previously produced is lost again.

A swirl-producing device is also known from U.S. Pat. No. 5,018,501, which is disposed downstream of the valve seat face and comprises four swirl conduits of a fuel rotating element and a rotation chamber, in which the fuel is made to flow circularly around the rotation chamber. This kind of embodiment is complicated and expensive, and the sharp deflections lead to high flow resistances.

OBJECT AND SUMMARY OF THE INVENTION

The electromagnetically actuatable injection valve according to the invention has an advantage over the prior art that a swirl component is imparted to virtually all the fuel to be injected in a simple manner prior to its emergence from an injection port, and provision is made such that the fuel does not give up a majority of its swirl component again because of sharp deflections on downstream edges of a flow conduit bore. Because the swirl in the fuel is produced directly before the injection, even the fuel that is injected immediately after the opening of the injection valve already has a swirl.

A particularly advantageous feature is that the cross section of the swirl conduit increases over its length in the direction of the inventive port, so that the flow resistances are reduced to a minimum.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
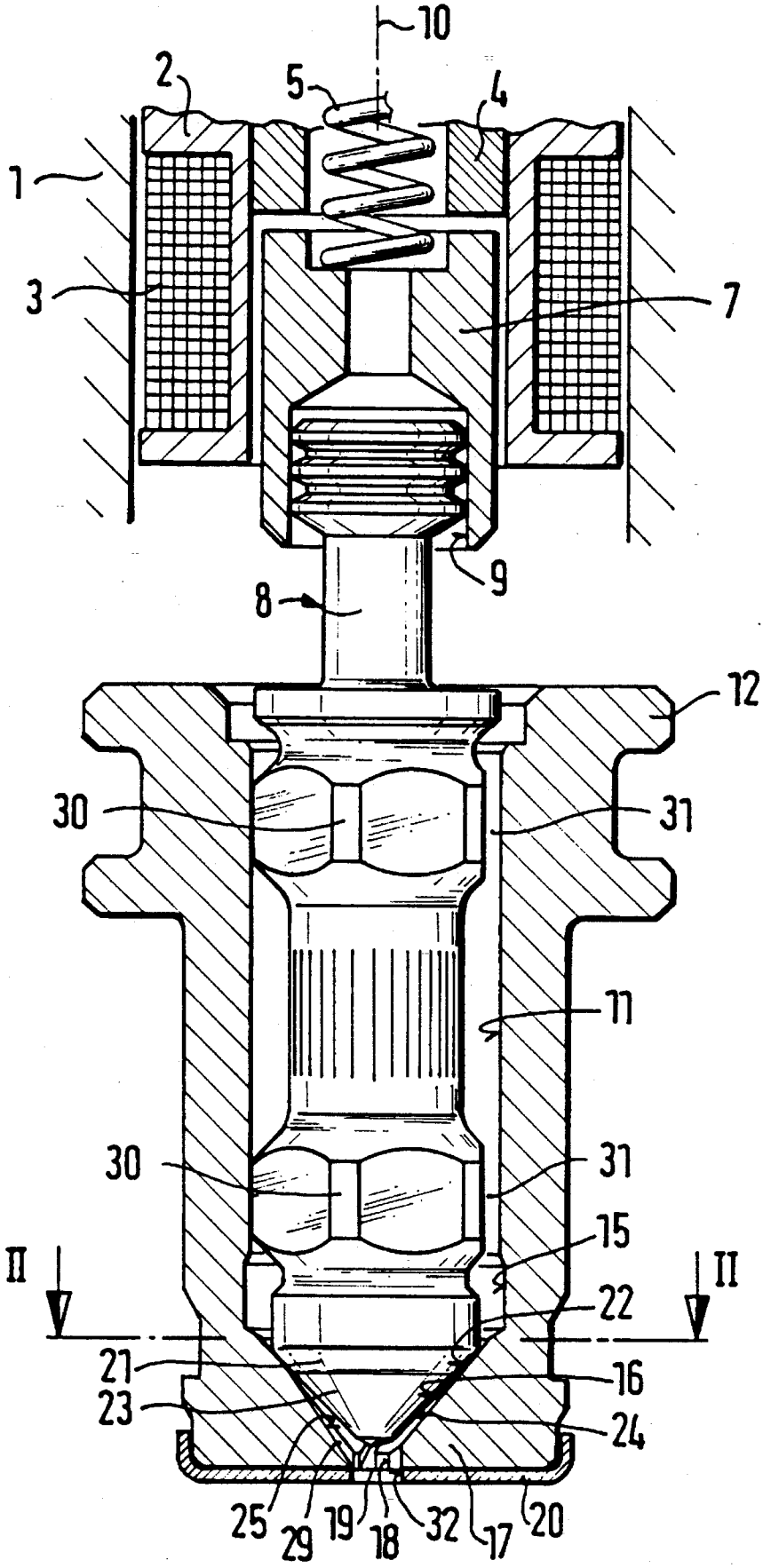
FIG. 1 is a section through an injection valve embodied according to the invention.

The drawing, in FIG. 1, shows a valve housing 1 of an injection valve, not shown in further detail, of a fuel injection system of a mixture-compressing internal combustion engine with externally supplied ignition; inside the valve housing is a magnet coil 3, mounted on a coil carrier 2. A ferromagnetic core 4 is located inside and partly surrounded by the magnet coil 3. An armature 7 acted upon by a restoring spring 5 is oriented toward a downstream face end of the core 4 and in turn partly surrounded by the coil carrier 2; the armature 7 has a recess 9, oriented toward a valve needle 8 which functions as the valve closing member and into which the valve needle 8 is firmly fitted. The valve needle 8 is supported axially displaceably in a flow bore 11, extending coaxially to a longitudinal valve axis 10, of a nozzle body 12 that is joined to the valve housing 1 in a manner not shown.

The flow bore 11, on its downstream end, has a shoulder making an undercut 15, required for production reasons, whose diameter is greater than that of the flow bore 11. The undercut 15 is adjoined downstream by a conically embodied valve seat face 16 of a valve seat 17, which discharges into an injection conduit 18 that is coaxial with the longitudinal valve axis 10 and is for instance cylindrical; it ends downstream in a terminal port 19. The terminal port 19 of the cylindrical injection conduit 18 is covered by a thin perforated plate 20, in which an injection port 32 that is concentric with the terminal port 19 is formed, through which injection port the metering of the fuel quantity to be injected is done. If the injection valve is made without the perforated plate 20, then the terminal port 19 of the injection conduit 18 acts as the injection port in which the fuel is metered.

The valve needle 8 passes with slight radial play through the flow bore 11 in the nozzle body 12, and on its downstream end the valve needle has a first cone 21, which has the same cone angle as the valve seat face 16 and, when the magnet coil 3 is not excited, rests tightly on a sealing face 22 of the valve seat face 16 having the same length, and with the sealing face 22 the cone section 21 forms a sealing seat 21, 22. The first cone section 21 of the valve needle 8 is adjoined downstream by a second cone section 23, which has a slightly larger cone angle than the first cone 21; as a result, an annular gap 24 that widens slightly in the flow direction is created between the second cone 23 and the valve seat face 16.

For opening the valve, the cone 21 lifts away from the sealing face 22 and thus opens up an annular gap-like flow cross section between the sealing face 22 of the valve seat face 16 and the cone 21 of the valve needle 8.

Figure 2:
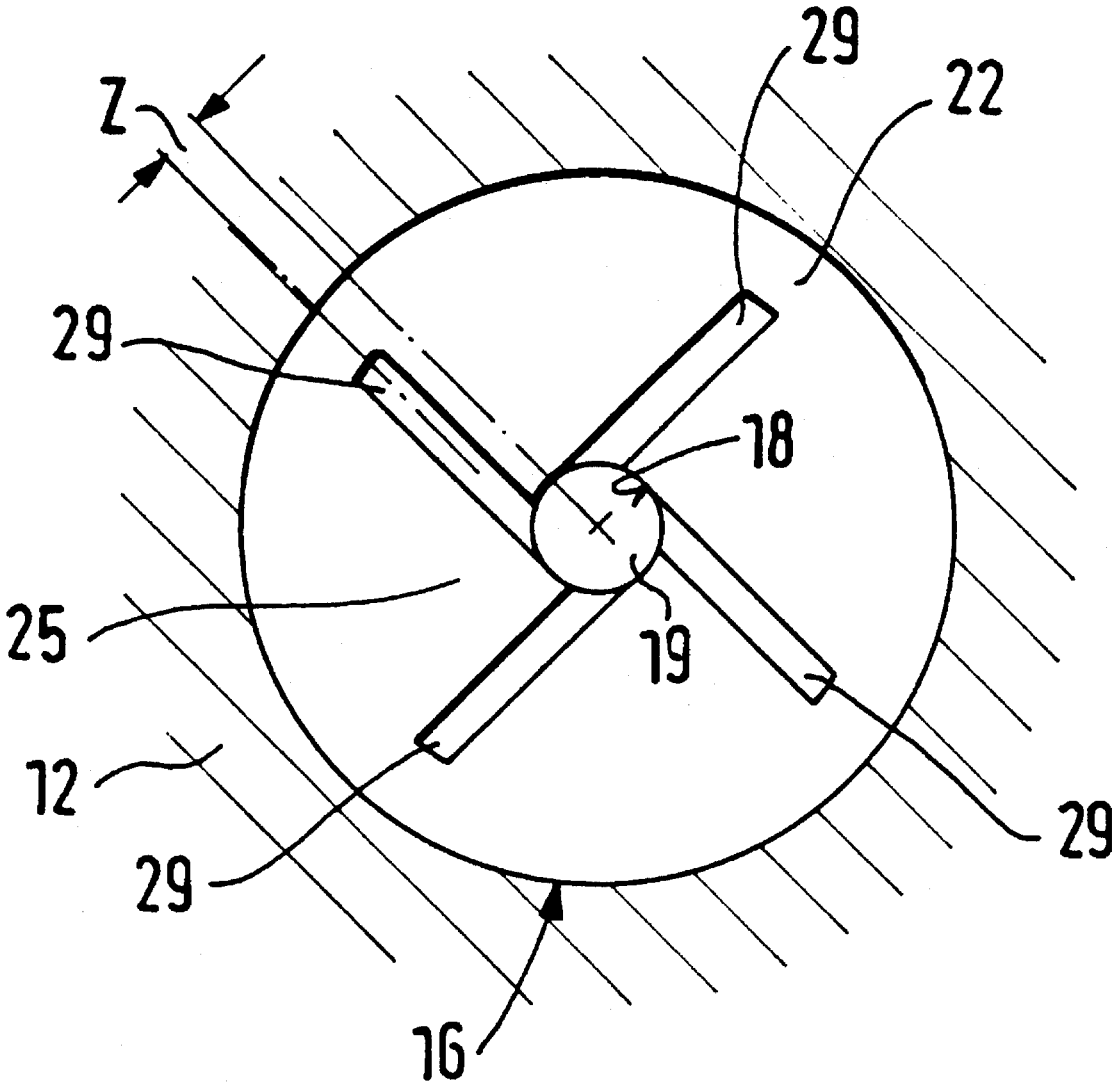
FIG. 2 is an enlarged plan view on a valve seat face according to the invention of the injection valve.

A swirl segment 25 of the valve seat face 16, located downstream of the sealing face 22, is provided with swirl conduits 29, for instance four in number, distributed uniformly over its circumference and open toward the valve seat face 16; their cross section increases in the direction of the injection conduit 18. To this end, either the width can increase while the depth remains the same over its length, or as shown in FIGS. 1 and 2 of the drawing, the depth or the depth and the width of the swirl conduits 29 can increase while the length remains the same. FIG. 2 of the drawing shows the valve seat face 16 in an enlarged view in the flow direction, with the four swirl conduits 29, which extend along the swirl segment 25 of the valve seat face 16 and through the conduit 18 down to the terminal port 19. The swirl conduits 29 discharge into the conduit 18 and terminal port 19, for instance at a tangent, with a lateral offset "Z" with respect to the longitudinal valve axis 10. The size of the lateral offset "Z" influences the swirl component imparted to the fuel stream. At the same time, the injection angle of the fuel stream can be varied by means of the lateral offset "Z".

The swirl conduits 29 may for instance be embodied as rectangular grooves, which are produced either by stamping, electrolytic machining, or erosion.

With the valve opened, the fuel flows through the flow cross section between the valve seat face 16 and the valve needle 8, and then in the narrow annular gap 24, because of the shaping of the cone 23, is for the most part forced into the swirl conduits 29, as a result of which virtually the entire fuel quantity emerges with a swirl from the injection port 32 of the perforated plate 20. The fuel stream is torn away and atomized into superfine droplets, and as a result very good combustion in an engine combustion chamber is attained.

The valve needle 8 has at least two guide segments 30, spaced axially apart, which guide the valve needle 8 in the flow bore 11. On their circumference, both guide segments 30 have flow openings 31, which allow the fuel to flow past the guide segments 30.

The injection valve according to the invention is especially suitable for use in mixture-compressing internal combustion engines with externally supplied ignition, whose running properties and efficiency depend quite substantially on the degree of atomization of the fuel injected into a combustion chamber of the engine.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electromagnetically actuatable injection valve for fuel injection systems of internal combustion engines, having a core, a magnet coil and an armature, an actuatable conical valve closing member comprising a first cone (21) and downstream thereof a second cone (23), said first cone (21) cooperating with a conical sealing face of a conical valve seat face (16) of a nozzle body, said second cone (23) extends as far as said valve seat face extends, an injection conduit (18) is disposed downstream of the valve seat face in said nozzle body, said injection conduit having an inlet at a downstream end of said valve seat face and has an outlet downstream of said inlet and the valve seat face, which forms a terminal port (19) at said outlet, the valve seat face (16) downstream of the sealing face (22), has at least one swirl conduit (29) which opens toward the second cone (23) on said closing member, said at least one swirl conduit is located in a swirl segment (25) of said nozzle body and extends in said nozzle body down to the terminal port (19) of the injection conduit (18).

2. An injection valve as defined by claim 1, in which the at least one swirl conduit (29) has a cross section that increases in a downstream direction.

3. An injection valve as defined by claim 2, in which a narrow, gradually widening annular gap (24) in a flow direction is formed between the swirl segment (25) of the valve seat face (16) and the conical valve closing member (8, 23).

4. An injection valve as defined by claim 1, in which a narrow, gradually widening annular gap (24) in a flow direction is formed between the swirl segment (25) of the valve seat face (16) and the conical valve closing member (8, 23).

5. An injection valve as defined by claim 1, in which the at least one swirl conduit (29) discharges into the injection conduit (18) laterally offset a selected distance (Z) with respect to a longitudinal valve axis (10).

6. An injection valve as defined by claim 1, in which the terminal port (19) of the injection conduit (18) is covered by a thin perforated plate (20), which has an injection port (32) concentric with the terminal port (19).

* * * * *